US007056078B2

(12) United States Patent
Seaberg

(10) Patent No.: US 7,056,078 B2
(45) Date of Patent: Jun. 6, 2006

(54) HYDRAULICALLY-SYNCHRONIZED CLAMP FOR HANDLING STACKED LOADS DIFFERENT SIZES

(75) Inventor: Richard D. Seaberg, Brush Prairie, WA (US)

(73) Assignee: Cascade Corporation, Portland, OR (US)

( * ) Notice: Subject to any disclaimer, the term of this patent is extended or adjusted under 35 U.S.C. 154(b) by 313 days.

(21) Appl. No.: 10/670,451

(22) Filed: Sep. 24, 2003

(65) Prior Publication Data

US 2005/0063811 A1 Mar. 24, 2005

(51) Int. Cl.
*B66F 9/06* (2006.01)

(52) U.S. Cl. ..... 414/623; 414/911; 294/87.1

(58) Field of Classification Search ..... 414/618, 414/620, 623, 736, 911; 294/87.1
See application file for complete search history.

(56) References Cited

U.S. PATENT DOCUMENTS

| | | | | |
|---|---|---|---|---|
| 715,365 | A | | 12/1902 | French |
| 1,103,036 | A | | 7/1914 | Clark |
| 2,545,260 | A | | 3/1951 | Cole |
| 2,706,060 | A | | 4/1955 | Ferrario et al. |
| 3,168,203 | A | | 2/1965 | Gallistel |
| 3,241,687 | A | | 3/1966 | Orloff |
| 3,314,555 | A | | 4/1967 | Baker et al. |
| 3,583,586 | A | | 6/1971 | Burton |
| 3,905,635 | A | | 9/1975 | Esser |
| 3,990,594 | A | | 11/1976 | Olson et al. |
| 4,127,205 | A | | 11/1978 | Farmer et al. |
| 4,161,256 | A | * | 7/1979 | Seaberg ..... 414/620 |
| 4,313,633 | A | | 2/1982 | Muntjanoff et al. |
| 4,318,661 | A | | 3/1982 | Helm |
| 4,351,553 | A | | 9/1982 | Rovetta et al. |
| 4,367,891 | A | | 1/1983 | Wauer et al. |
| 4,396,215 | A | | 8/1983 | McCutcheon |
| 4,397,495 | A | | 8/1983 | Lewis |
| 4,435,117 | A | | 3/1984 | House |
| 4,502,723 | A | | 3/1985 | Kuromoto |
| 4,682,931 | A | | 7/1987 | House |
| 4,748,570 | A | | 5/1988 | Shochi et al. |
| 4,783,106 | A | | 11/1988 | Nutter |
| 4,907,834 | A | | 3/1990 | dejong et al. |
| 5,308,132 | A | | 5/1994 | Kirby et al. |

(Continued)

FOREIGN PATENT DOCUMENTS

FR 2578824 9/1986

OTHER PUBLICATIONS

"Auramo RC-250J," 1 page (1976).
"Yamakawa Detent Linkage," 3 pages (1990).
"Cascade Japanese Pin-in-Socket Linkage," 2 pages (1990).

*Primary Examiner*—James W. Keenan
(74) *Attorney, Agent, or Firm*—Chernoff Vilhauer McClung & Stenzel, LLP

(57) ABSTRACT

A clamp for handling stacked loads of different sizes has a hydraulic circuit capable of selectively causing closing movement of a pair of clamp arms in synchronized unison with each other and thereafter, automatically in response to resistance to closing movement by one but not the other of the pair of clamp arms, causing unsynchronized closing movement of the other clamp arm. Subsequently, upon opening of the clamp, the hydraulic circuit initially causes opening movement of the previously unsynchronized clamp arm and thereafter, automatically in response to the attainment of synchronized clamp arm positions, causes opening movement of the pair of clamp arms in synchronized unison with each other.

13 Claims, 4 Drawing Sheets

U.S. PATENT DOCUMENTS 5,335,955 A 8/1994 Pekka et al.
5,417,464 A 5/1995 Seaberg et al.
5,536,133 A * 7/1996 Velez et al. ..... 414/620
5,558,380 A 9/1996 Meyer et al.
5,984,617 A 11/1999 Seaberg
6,027,302 A 2/2000 Nilsson
6,318,949 B1 11/2001 Seaberg
6,390,751 B1 5/2002 Jordan et al.

* cited by examiner

HYDRAULICALLY-SYNCHRONIZED CLAMP FOR HANDLING STACKED LOADS DIFFERENT SIZES

BACKGROUND OF THE INVENTION

The present invention is directed to an improved load-handling clamp capable of handling two or more stacked loads of differing sizes, such as vertically-stacked abbreviated-height paper rolls of different diameters. Such a clamp is often referred to as a split-arm clamp. Preferably, the clamp is also useful for handling a single full-height or abbreviated-height load, or multiple stacked loads of the same size.

Such a split-arm clamp normally consists of at least a pair of separately-actuated clamp arms on one side of the clamp, in opposed relation to a single larger clamp arm on the opposite side of the clamp. The separately-actuated clamp arms are powered by separate hydraulic actuators connected in parallel to a source of pressurized fluid, and give the clamp the ability to apply clamping force separately to multiple objects of different widths or diameters stacked one atop the other. Such clamping capabilities are useful, for example, with respect to stacked paper rolls, bales or cartons of different sizes.

A common problem with such a clamp is misalignment of the separately-actuated clamp arms due to different frictional resistances in the respective arm mechanisms as they close or open, and/or different starting positions of the clamp arms when they close or open. If the clamp arms are misaligned to any extent, their combined profile will usually be thicker than normal. If the operator is unaware of such a misalignment, the clamp arms can strike a paper roll or other fragile load located inside the arms or adjacent loads located outside the arms as the arms are inserted or withdrawn in the course of engaging or depositing a load, causing substantial damage to the load. Correction of such misalignment often necessitates opening or closing the clamp arms to their maximum extent to realign them, which is time-consuming and requires operating space which may not be available.

A related problem is that, if only a single abbreviated-height paper roll or other single load is to be handled, clamping pressure on the load-engaging clamp arm cannot be obtained until the other separately-actuated arm is closed to its maximum extent. Conversely, opening of the clamp arms sometimes requires full opening of one clamp arm before another can be released sufficiently to disengage a load. In either case, the resultant high degree of misalignment of the clamp arms maximizes the time and space requirements for operating the clamp, and maximizes the risk of damage to the loads.

U.S. Pat. No. 4,682,931 offers a partial solution to these prior problems by providing a flow regulator of the divider/combiner type which requires the respective movements (or lack thereof) of a pair of clamp arms during closing and opening to be synchronized until the regulator is overridden, after which nonsimultaneous movement of the clamp arms is enabled. U.S. Pat. No. 5,984,617 improves on this system by making it compatible with clamp force adjustment systems. However, after the regulator has been overridden, the resultant unsynchronized arms must be opened or closed fully to resynchronize their positions, requiring extra time and space which may not be available.

Mechanical, rather than flow-regulating, solutions to the foregoing problems of unsynchronized clamp arms have been attempted in the past. These alternative solutions interconnect separately-actuated clamp arms by means of mechanical linkages which permit only a limited range of movement between the clamp arms. Such mechanical linkages include simple flexible or articulated tether-type links, or mechanical or hydraulic balance-beam links, which prevent more than a predetermined misalignment of the clamp arms. These linkages, however, share the common problem that they do not correct misalignment of the clamp arms and return them to their synchronized positions automatically to minimize their combined thickness.

Other previous linkage mechanisms include a spring-biased detent assembly tending to hold separately-actuated clamp arms in alignment with each other, but allowing large deviations from alignment whenever the spring-biased holding force of the detent is overcome by the fluid power actuators of the clamp arms. Such an arrangement provides neither adequate limitations on the misalignment of the clamp arms, nor automatic correction of such misalignment. Moreover, when only a single abbreviated-height load is to be handled, clamping pressure on the load-engaging clamp arm cannot be attained until the other clamp arm is fully closed.

A spring-link system shown in U.S. Pat. No. 6,318,949 is designed to cause synchronization automatically upon opening of the clamp arms. However the spring is limited in its ability to provide sufficient force to transfer hydraulic fluid rapidly enough to cause immediate realignment of the clamp arms. Moreover, such a spring link system can cause excessive mechanical limitations on visibility and the permitted extent of misalignment, depending on the particular profiles of the clamp arms. Also, clamping only a single load exerts the force of both fluid actuators into one clamping arm.

BRIEF SUMMARY OF THE INVENTION

The present invention overcomes the foregoing deficiencies of prior split-arm clamps by providing a clamp with an improved hydraulic circuit interconnecting the separate fluid-actuated clamp arms.

In its preferred embodiment, the clamp has a hydraulic circuit capable of selectively causing closing movement of a pair of clamp arms in synchronized unison with each other and thereafter, automatically in response to resistance to closing movement by one but not the other of the pair of clamp arms, causing unsynchronized closing movement of the other clamp arm. Subsequently, upon opening of the clamp, the hydraulic circuit initially causes opening movement of the previously unsynchronized clamp arm and thereafter, automatically in response to the attainment of synchronized clamp arm positions, causes opening movement of the pair of clamp arms in synchronized unison with each other.

The foregoing and other objectives, features, and advantages of the invention will be more readily understood upon consideration of the following detailed description, taken in conjunction with the accompanying drawings.

DETAILED DESCRIPTION OF THE EMBODIMENTS

Figure 1:
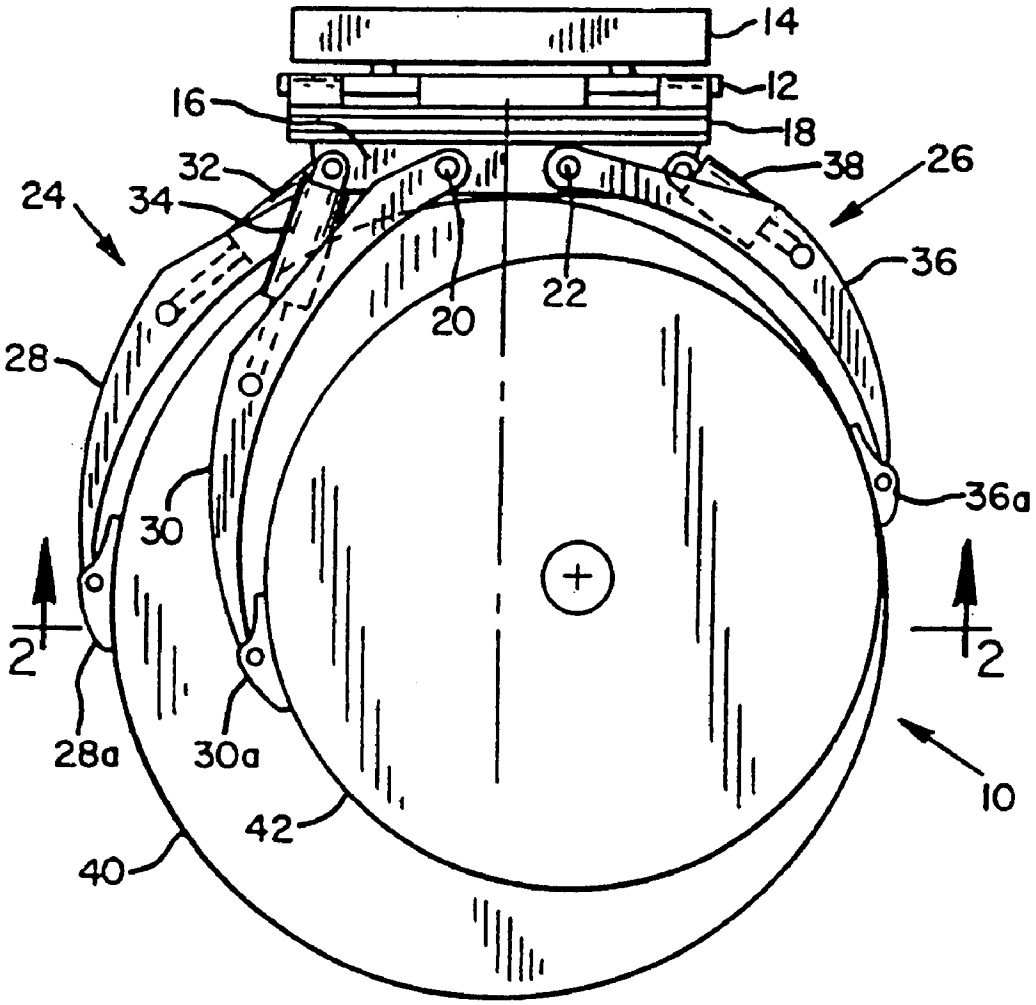
FIG. 1 is a simplified top view of an exemplary paper roll clamp embodying the present invention, shown in engagement with a pair of stacked rolls of different diameters.

An exemplary paper roll clamp, designated generally as 10 in FIG. 1, is mounted on a vertically-reciprocating carriage 12 carried by a lift truck mast 14. The clamp comprises a frame 16 mounted on the load carriage 12 connected either fixedly thereto or, as shown in FIG. 1, by a rotator assembly 18. Pivotally mounted to the frame 16 at pivot points 20, 22 are a pair of opposing clamping assemblies designated generally as 24 and 26. The clamping assembly 24 comprises a pair of vertically-spaced clamp arms 28 and 30, having respective load engagement pads 28*a* and 30*a*, movable separately from each other relative to the frame 16 selectively toward and away from the opposed clamping assembly 26 under the control of fluid power actuators 32 and 34 respectively, each consisting of a double-acting, bidirectional hydraulic cylinder connected between the frame 16 and a respective clamp arm 28 or 30. The opposed clamping assembly 26, on the other hand, consists of only a single clamp arm 36 having one or more elongated load-engagement pads such as 36*a* extending so as to oppose the pads of both of the clamp arms 28 and 30. The clamp arm 36 pivots with respect to the frame 16 under the control of a pair of further fluid power actuators 38. Alternatively, the arm 36 could be fixed with respect to the frame 16.

The load clamp 10 engages multiple stacked half-height paper rolls, such as 40 and 42, of different diameters so as to transport them simultaneously from one location to another. The clamp can also engage and transport only a single full-height or half-height paper roll, such as roll 40, or a pair of half-height rolls of the same diameter in stacked relationship. Transporting of the rolls requires that each be engaged with sufficient clamping force, by the respective pads 28*a*, 30*a* and 36*a*, to be able to frictionally support the weight of the rolls vertically. In operation, the clamping force is determined by the pressure of hydraulic fluid tending to extend hydraulic cylinders 32 and 34, respectively, to close the clamp arms. Cylinders 38 are principally used to position clamp arm 36 prior to clamping if necessary.

Figure 3:
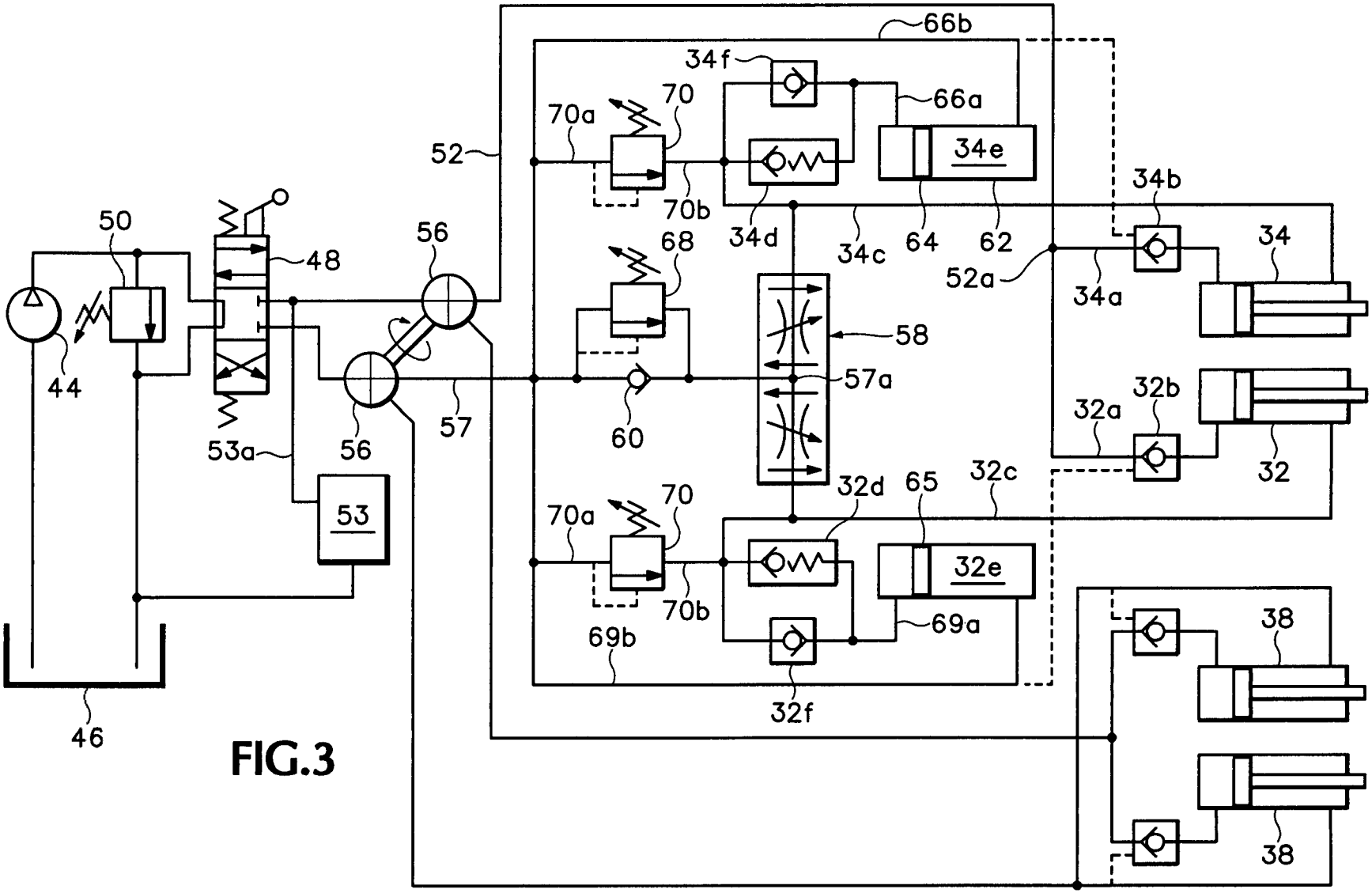
FIG. 3 is a hydraulic circuit diagram of a preferred embodiment of the present invention.

The hydraulic circuitry will first be explained with reference to the preferred embodiment of FIG. 3. A hydraulic pump 44, driven by the lift truck engine, delivers fluid under pressure from a hydraulic reservoir 46 to a manually-operable clamp arm directional control valve 48 shown in its centered, or unactuated, condition. A lift truck relief valve 50 sets an upper limit on the pressure of the fluid delivered by pump 44 by opening and bleeding fluid back to the reservoir 46 in response to excessive fluid pressure as determined by the variable setting of the relief valve 50.

Figure 4:
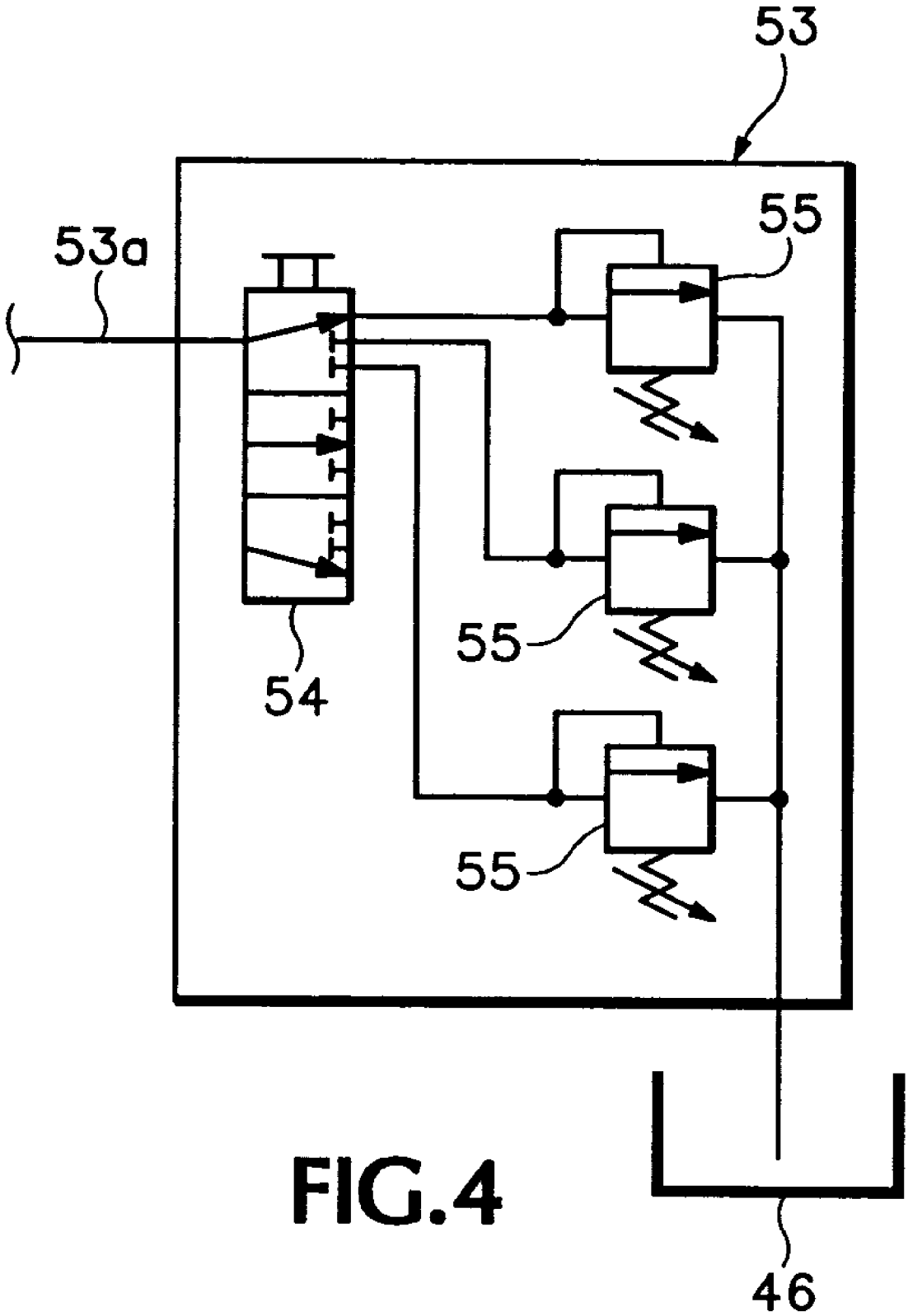
FIG. 4 is a detail view of a portion of FIG. 3.

In addition to the lift truck relief valve 50, a pressure-limiting valve assembly 53 (FIG. 4) can be optionally provided which comprises at least one adjustable pressure-relief valve 55 and preferably two or more adjustable pressure-relief valves 55 with different relief settings all below that of valve 50. The valve assembly 53 variably limits the fluid pressure in a clamp-closing conduit 52 for different types and/or weights of loads. The pressure limit controlled by the valve assembly 53 can be varied manually by the operator, for example by manipulation of a selector valve 54 connected to conduit 52 by line 53*a*.

The valve assembly 53 could alternatively comprise one or more pressure-reducing valves, instead of the relief valves 55, connected in series with the clamp-closing conduit 52 if desired. Or, as a further alternative, such pressure limit could be varied automatically by an adaptive system capable of varying the pressure limit in response to the sensed weight of the load clamped between the opposing clamp assemblies 24 and 26. An example of such an adaptive system is shown in U.S. Pat. No. 6,390,751, which is incorporated herein by reference.

Fluid power actuators 38, if present, could be controlled by a directional control valve separately from valve 48. However, as shown in FIG. 3, they are preferably controlled by the same control valve 48 in response to rotation of the clamp arms by the rotator assembly 18 to a predetermined orientation between horizontal and vertical, where a pair of interconnected rotary valves 56 allow the control valve 48 to control the cylinders 38 instead of the cylinders 32 and 34, in a well-known manner.

In operation, closure of the clamp arms 28 and 30 begins with the clamp arms in synchronized, preferably aligned, positions relative to each other. Closure is accomplished by the lift truck operator's manipulation of valve 48 to deliver pressurized fluid from the pump 44 through the clamp-closing conduit 52 and a parallel connection 52*a* to the hydraulic cylinders 32 and 34 through their respective conduits 32*a* and 34*a* and pilot-operated check valves 32*b* and 34*b*, respectively. As the cylinders 32 and 34 extend, fluid is simultaneously exhausted from the cylinders through conduits 32*c* an 34*c*, respectively, and through a parallel connection 57*a* to a clamp-opening conduit 57. In the preferred embodiment of FIG. 3, the parallel connection 57*a* includes a fluid-flow regulator 58, preferably of a conventional flow divider/combiner type although other types of flow regulators could alternatively be used. During closure of the clamp arms, the flow regulator 58 combines the flows from conduits 32*c* and 34*c* into a merged exhaust flow which passes through a check valve 60 and through conduit 57 and control 48 to the reservoir 46. The regulator 58 also causes the respective volumetric flow rates in conduits 32*c* and 34*c* to be proportional to each other and, assuming that the cylinders 32 and 34 are of the same displacement, preferably equal to each other. Thus, the regulator 58 causes the clamp arms 28 and 30 to execute their closing movements in unison and in synchronized, substantially aligned, positions with respect to each other so that the thickness of the combined profile of the clamp arms is minimized.

Figure 2:
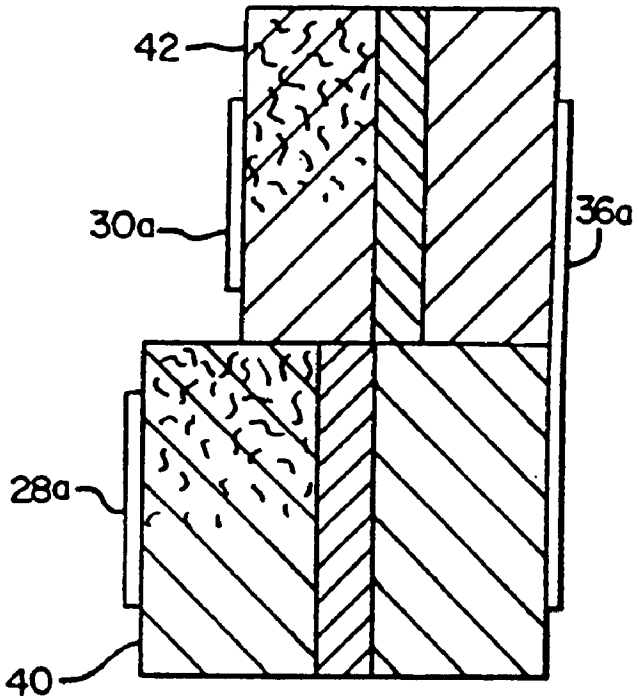
FIG. 2 is a reduced, simplified front view of the embodiment of FIG. 1.

Assuming that rolls of different diameters corresponding to rolls 40 and 42 are to be engaged, clamp arm 28 would be the first to encounter resistance to its closing movement because roll 40 has the larger diameter. This resistance restrains the further extension of cylinder 32 and thus stops the flow exhausted through conduit 32*c*. In response thereto, the flow regulator 58 also stops flow through conduit 34*c*, which would ordinarily prevent further extension of cylinder 34 and further closure of clamp arm 30 even though, at this point, the clamp arm 30 has not yet engaged the smaller-diameter roll 42. However, in the embodiment of FIG. 3, continued actuation of the control valve 48 tending to close the clamp arms causes the fluid pressure in conduit 34*c* to increase because the cylinder 34 has not yet encountered any load resistance. The fluid pressure in conduit 34*c* thereby overcomes the pressure setting of a valve 34*d* of a fluid bypass assembly which includes conduits 66*a* and 66*b* and an interposed fluid-flow limiter 34*e*. The fluid flow limiter 34*e* preferably consists of a fixed displacement fluid cylinder 62 having a free-moving piston 64 therein which divides the cylinder 62 into two fluid-holding chambers. The flow from conduit 66*a* into the flow limiter 34*e* moves the piston 64 to the right in FIG. 3, which exhausts fluid through conduit 66*b* into conduit 57 in parallel with the flow regulator 58, thereby causing further extension of the cylinder 34 due to the pressure in conduit 52, and further closing movement of the clamp arm 30, separately from the clamp arm 28 which is restrained against further movement. This causes the clamp arms 30 and 28 to assume respective unsynchronized positions relative to each other, enabling the clamp arm 30 to fully engage the smaller-diameter roll 42 as shown in FIGS. 1 and 2. Alternatively, if the free-moving piston 64 of the flow limiter 34*e* were to reach the extremity of its movement to the right in FIG. 3 due to the absence of any roll 42, the clamp arm 30 would cease its closing movement with the clamp arm 28 fully engaged with the roll 40 due to the pressure in conduit 52. In any case, either both of the loads 40 and 42, or at least the load 40 in the absence of a load 42, are then ready to be hoisted by the lift truck and the operator may therefore center the control valve 48 and hoist the roll(s).

When the operator subsequently desires to deposit the roll(s), he lowers the roll(s) to a supporting surface and moves the valve 48 in the opposite direction from its centered position, which introduces pressurized fluid from the pump 44 into the clamp-opening conduit 57. Initially, however, such pressure in the clamp-opening conduit 57 does not result in parallel flows through the flow regulator 58 because the check valve 60 and pressure-responsive sequence valve 68 initially prevent any flow through the flow regulator 58. However, the pilot-operated check valves 32*b* and 34*b* are both unseated by the pressure in conduit 57 to enable the retraction of the cylinders 32 and 34. Therefore, pressure in conduit 57 and bypass conduit 66*b* begins pushing the previously rightwardly-positioned piston 64 of the flow limiter 34*e* to the left in FIG. 3, thereby causing the exhaust of fluid under pressure from the flow limiter 34*e* through conduit 66*a*, check valve 34*f* and conduit 34*c* to retract the cylinder 34. This causes opening movement of the previously unsynchronized clamp arm 30, which at this point is in a more closed position as compared to clamp arm 28 due to its previous engagement of the smaller roll 42. Meanwhile, another bypass conduit 69*b*, which is preferably also part of the bypass assembly for reasons to be explained hereafter, is similarly pressurized. However, no similar retraction of cylinder 32 occurs at this time because its respective bypass flow limiter 32*e* still has its free-moving piston 65 at its leftward extremity as a result of the previous engagement of clamp arm 28 with the larger roll 40, thereby preventing retracting flow from the flow limiter 32*e* through conduit 32*c*. Accordingly clamp arm 28 initially performs no opening movement while clamp arm 30 independently performs it opening movement from its more closed position toward the stationary clamp arm 28 to attain a synchronized position with respect thereto.

When the piston 64 of the flow limiter 34*e* reaches its leftward extremity of travel, the pair of clamp arms 28 and 30 are once more in their original synchronized positions relative to each other. Thereafter, since pistons 64 and 65 are now both in their extreme leftward positions in flow limiter 34*e* and 32*e* respectively, the pressure in conduit 57 increases to the point where it exceeds the pressure setting of sequence valve 68. Thus, valve 68 automatically opens and introduces flow to the flow regulator 58 which, operating in its dividing mode, thereby causes opening movement of the clamp arms 28 and 30 in synchronized unison with each other.

The foregoing functions are preferably interchangeable with respect to the clamp arms 28 and 30. If the vertical positions of the clamp arms 28 and 30 are reversed by the rotator 18 so that the larger-diameter roll 40 is engaged by the clamp arm 30, then the clamp arm 30 and cylinder 34 are the first to encounter the resistance of the larger-diameter roll 40 and to be restrained against further closing movement. In such case the cylinder 32 continues its closing movement separately, with a valve 32*d*, conduit 69*a*, flow limiter 32*e* and conduit 69*b* of a preferable second branch of the bypass assembly working in the same manner previously described with respect to valve 34*d*, conduit 66*a*, flow limiter 34*e* and conduit 66*b*. Later, during opening movement of the clamp arms, flow limiter 32*e* and check valve 32*f* operate as described previously with respect to flow limiter 34*e* and check valve 34*f* to cause initial separate opening movement of clamp arm 28 while clamp arm 30 remains stationary, until the pair of clamp arms attain synchronization. Then, when the clamp arms becomes synchronized, opening movement of the pair of clamp arms proceeds in synchronized unison due to the opening of sequence valve 68 and the operation of flow regulator 58 in its dividing mode as described above.

Valves 70 and their connecting lines 70*a*, 70*b* can be optionally provided if desired to ensure that the clamp arms will open completely in cases where, due to malfunction or low fluid flow rates, the flow regulator 58 prevents the intended passage of fluid in a direction to open the clamp arms.

Alternatives to the flow limiters 32*e* and 34*e* can also optionally be used. For example, rotary-type flow limiters could be used instead of linear-type flow limiters as shown. Alternatively, other devices such as clamp-arm proximity sensors or flow-measuring sensors could mechanically, hydraulically or electrically open or lose valves in the system to accomplish a similar purpose.

The flow limiters 32*e* and 34*e*, or their foregoing alternatives, can be made adjustable so that their control over the permitted movement of one clamp arm relative to the other can be selectively varied for different applications. For example, the displacements of the flow limiters can be changed by changing their cylinder diameters or piston lengths, or by using adjustable stops or end spacers in the cylinders.

Figure 5:
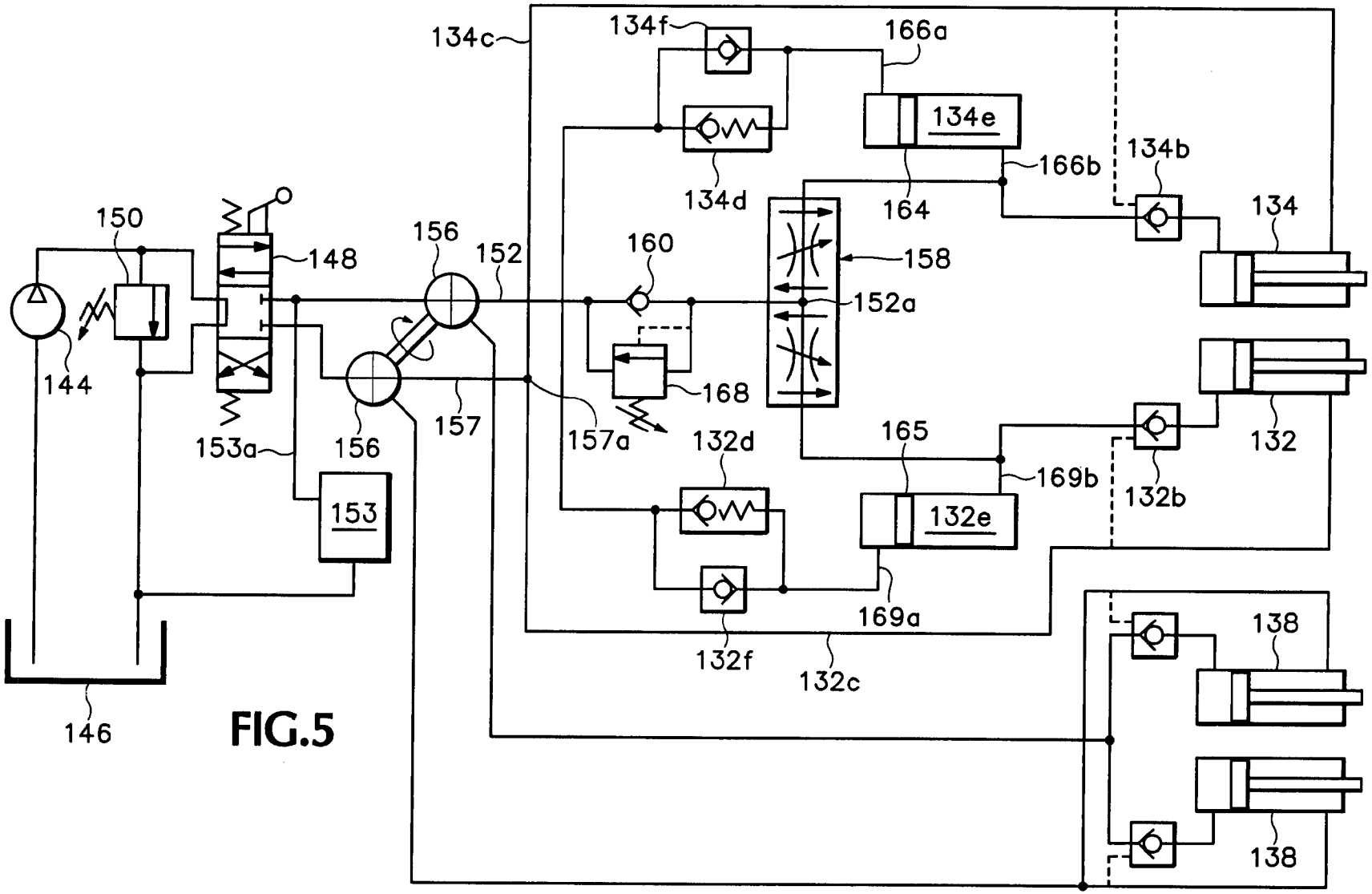
FIG. 5 is a hydraulic circuit diagram of an alternative embodiment of the present invention.

FIG. 5 shows an alternative version of the hydraulic circuit where a fluid flow regulator 158, similar to flow regulator 58, is interposed in a clamp-closing conduit 152 instead of a clamp-opening conduit 157. (In FIG. 5, those elements whose functions generally correspond to the elements of FIG. 3 have the same reference numerals increased by 100.) In FIG. 5, the flow regulator 158 operates in a dividing mode during clamp arm closing movement to accomplish the function of initially causing synchronized closing movement of the clamp arms. When one of the cylinders 132 or 134 becomes restrained against closure due to engagement of its clamp arm with the larger paper roll, the flow regulator 158 interrupts flow to both cylinders. At that point flow continues from conduit 152 through a valve 134*d* and bypass conduit 166*a*, or through a valve 132*d* and bypass conduit 169*a*, to the particular flow limiter 134*e* or 132*e* associated with the unrestrained clamp arm to permit its further independent closing movement as described above. In the FIG. 5 version of the circuit, valves 134*d* and 132*d* are preferably kick-down relief valves so as not to diminish the clamp-closing pressure.

Later, upon opening pressure being applied through the clamp-opening conduit 157, the cylinder 132 or 134 which is further extended due to its association with the previously unrestrained, and now unsynchronized, clamp arm, initially executes its independent opening movement by exhausting fluid through its associated flow limiter to conduit 152 until the piston 164 or 165 of its associated flow limiter reaches its leftward extremity. At this point the resulting increasing exhaust pressure opens sequence valve 168, and the cylinders and their respective clamp arms execute their opening movements in unison under the synchronized control of flow regulator 158 operating in its combining mode.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

The invention claimed is:

1. A load-handling clamp adapted to be mounted upon the lifting apparatus of a lift truck, comprising:

(a) a frame adapted to be mounted upon said lifting apparatus so as to be selectively movable vertically by said lifting apparatus;

(b) first and second opposing clamping assemblies mounted upon said frame, the first clamping assembly comprising at least a pair of clamp arms movable separately from each other relative to said frame selectively toward and away from the second clamping assembly;

(c) a pair of bidirectional fluid power actuators each capable of moving a respective one of said pair of clamp arms selectively either in a closing movement toward said second clamp assembly or in an opening movement away therefrom;

(d) a hydraulic circuit connected to said actuators capable of selectively causing said closing movement of said pair of clamp arms in unison with each other while said clamp arms are in respective synchronized positions relative to each other and thereafter, automatically in response to a resistance to closing movement of one but not the other of said pair of clamp arms, causing closing movement of said other of said pair of clamp arms so that said pair of clamp arms assume respective unsynchronized positions relative to each other;

(e) said hydraulic circuit being capable of selectively causing opening movement of said other of said pair of clamp arms while said pair of clamp arms are in respective unsynchronized positions relative to each other so as to cause attainment by said clamp arms of respective synchronized positions relative to each other and thereafter, automatically in response to said attainment, causing opening movement of said pair of clamp arms in unison with each other while said clamp arms are in respective synchronized positions relative to each other.

2. The apparatus of claim 1 wherein said hydraulic circuit is capable of causing said closing movements and opening movements interchangeably with respect to said pair of clamp arms.

3. The apparatus of claim 1 wherein said hydraulic circuit includes a fluid flow limiter connected to said actuators capable of limiting relative movement between said pair of clamp arms.

4. The apparatus of claim 3 wherein said fluid flow limiter is capable of limiting fluid flow which moves said other of said pair of clamp arms during closing movement thereof while said clamp arms assume said respective unsynchronized positions relative to each other.

5. The apparatus of claim 3 wherein said fluid flow limiter is capable of limiting fluid flow which moves said other of said pair of clamp arms during opening movement thereof so as to cause said attainment by said clamp arms of said respective synchronized positions.

6. The apparatus of claim 1 wherein said hydraulic circuit includes a fluid flow regulator, connected to said actuators, capable of causing respective proportional fluid flows through said regulator to and from said actuators.

7. The apparatus of claim 1 wherein each of said fluid power actuators has a respective first conduit and second conduit, the first conduits of said actuators being joined in a first parallel connection to a clamp-closing fluid conduit and the second fluid conduits of said actuators being joined in a second parallel connection to a clamp-opening fluid conduit, at least one of said first and second parallel connections including a fluid flow regulator capable of causing respective proportional fluid flows through said regulator to and from said actuators, said hydraulic circuit further including a fluid bypass assembly associated with said fluid flow regulator enabling a bypass flow causing said opening movement of said other of said pair of clamp arms while said pair of clamp arms are in respective unsynchronized positions relative to each other.

8. The apparatus of claim 7 wherein said hydraulic circuit includes a pressure-responsive valve enabling said bypass flow while simultaneously preventing flow through said flow regulator.

9. The apparatus of claim 7 including a fluid flow limiter capable of limiting said bypass flow.

10. A load-handling clamp adapted to be mounted upon the lifting apparatus of a lift truck, comprising:

(a) a frame adapted to be mounted upon said lifting apparatus so as to be selectively movable vertically by said lifting apparatus;

(b) first and second opposing clamping assemblies mounted upon said frame, the first clamping assembly comprising at least a pair of clamp arms movable separately from each other relative to said frame selectively toward and away from the second clamping assembly;

(c) a pair of bidirectional fluid power actuators each capable of moving a respective one of said pair of clamp arms selectively either in a closing movement toward said second clamp assembly or in an opening movement away therefrom;

(d) each of said fluid power actuators having a respective first conduit and second conduit, the first conduits of said actuators being joined in a first parallel connection to a clamp-closing fluid conduit and the second fluid conduits of said actuators being joined in a second parallel connection to a clamp-opening fluid conduit, at least one of said first and second parallel connections including a fluid flow regulator capable of causing respective proportional fluid flows through said regulator to and from said actuators; and (e) a fluid bypass assembly associated with said fluid flow regulator enabling a bypass flow causing opening movement of one of said pair of clamp arms without a proportional movement of the other of said pair of clamp arms upon actuation of opening movements of both of said pair of clamp arms.

11. The apparatus of claim 10 wherein said fluid bypass assembly is capable of enabling said bypass flow to cause said opening movement of either of said pair of clamp arms alternatively.

12. The apparatus of claim 10 wherein said fluid bypass assembly includes a pressure-responsive valve enabling said bypass flow while simultaneously preventing flow through said fluid flow regulator.

13. The apparatus of claim 10 including a fluid flow limiter capable of limiting said bypass flow.

* * * * *

UNITED STATES PATENT AND TRADEMARK OFFICE

CERTIFICATE OF CORRECTION

PATENT NO. : 7,056,078 B2
APPLICATION NO. : 10/670451
DATED : June 6, 2006
INVENTOR(S) : Richard D. Seaberg It is certified that error appears in the above-identified patent and that said Letters Patent is hereby corrected as shown below:

Col. 6, Line 24, Change “lose” to --close.--

Signed and Sealed this

Twelfth Day of December, 2006

JON W. DUDAS
*Director of the United States Patent and Trademark Office*